United States Patent [19]

Hendry

[11] 4,114,312

[45] Sep. 19, 1978

[54] TOY VEHICLE

[76] Inventor: David V. Hendry, R.R. #1, Box 109, Cochise, Ariz. 85606

[21] Appl. No.: 733,293

[22] Filed: Oct. 18, 1976

Related U.S. Application Data

[63] Continuation of Ser. No. 543,262, Jan. 23, 1975, abandoned.

[51] Int. Cl.[2] ..... A63H 17/26

[52] U.S. Cl. ..... 46/223; 46/17

[58] Field of Search ..... 46/17, 201, 202, 221, 46/222, 223, 16

[56] References Cited

U.S. PATENT DOCUMENTS

| | | | |
|---|---|---|---|
| 1,363,891 | 12/1920 | Lovington | 46/201 |
| 1,973,220 | 9/1934 | Mohr | 46/222 |
| 2,517,084 | 8/1950 | Carver | 46/221 X |
| 2,528,494 | 11/1950 | Brookshier | 46/221 X |
| 2,597,094 | 5/1952 | Gutmann | 46/222 X |
| 2,757,482 | 8/1956 | Brown et al. | 46/201 |
| 3,653,149 | 4/1972 | Prodger et al. | 46/201 |
| 3,668,804 | 6/1972 | Winston | 46/201 |
| 3,721,042 | 3/1973 | Marason, Jr. | 46/223 |

FOREIGN PATENT DOCUMENTS

| | | | |
|---|---|---|---|
| 1,368,912 | 6/1964 | France | 46/201 |
| 828,970 | 1/1952 | Fed. Rep. of Germany | 46/201 |
| 476,872 | 12/1952 | Italy | 46/201 |
| 945,178 | 12/1963 | United Kingdom | 46/221 |
| 991,823 | 5/1965 | United Kingdom | 46/221 |

*Primary Examiner*—F. Barry Shay

*Attorney, Agent, or Firm*—Warren D. Flackbert

[57] ABSTRACT

A toy in the form of a miniature vehicle characterized by a replaceable hood, as found on a conventional automobile, truck, or the like, spring-urged into a normal operating position upon assembly. The hood may be made of deformable material, e.g., aluminum foil.

3 Claims, 7 Drawing Figures

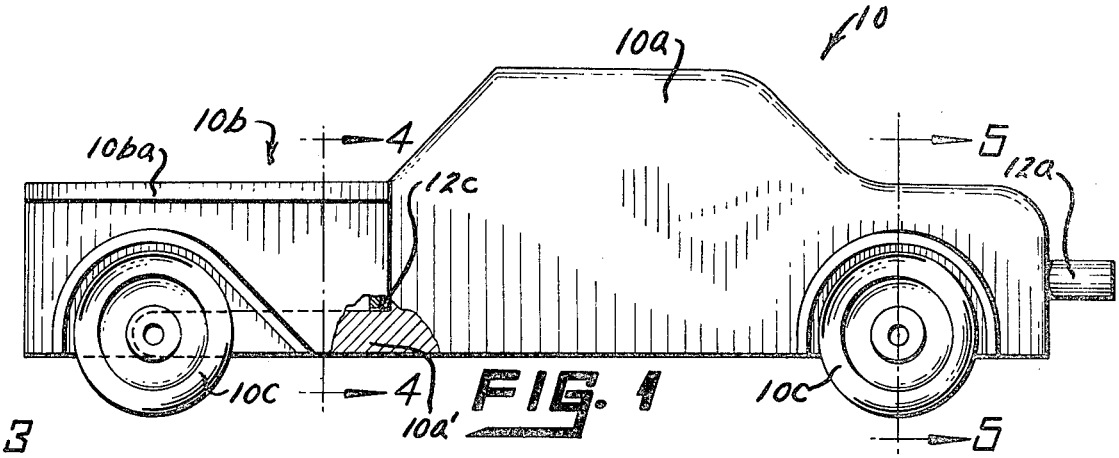
FIG. 1
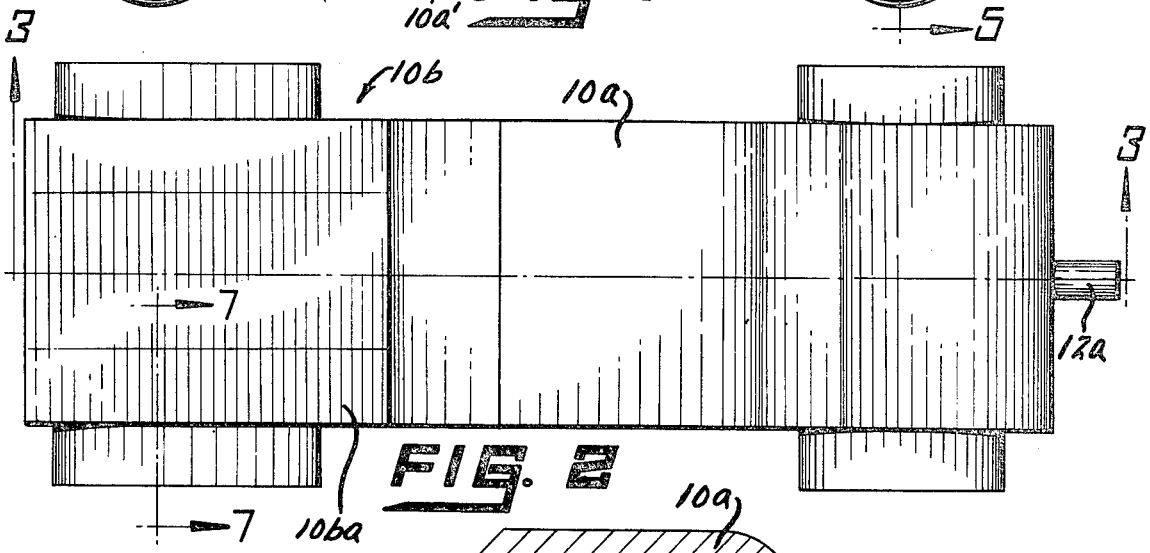
FIG. 2
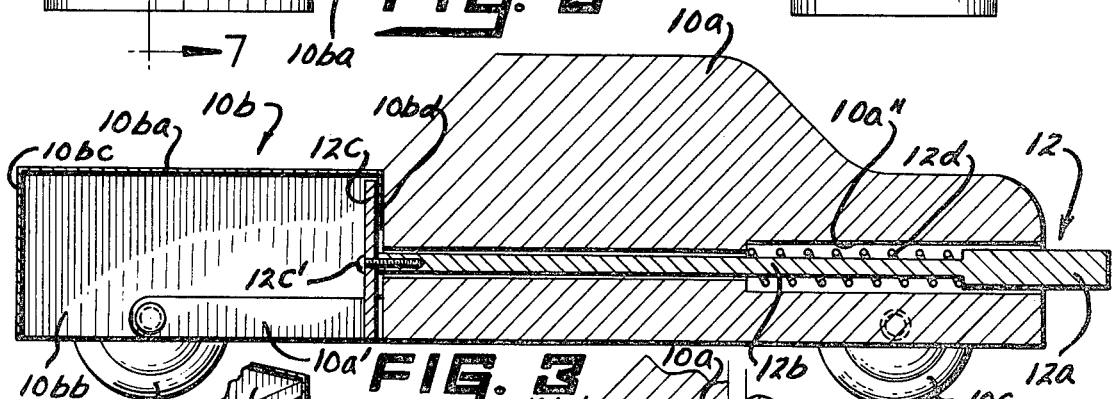
FIG. 3
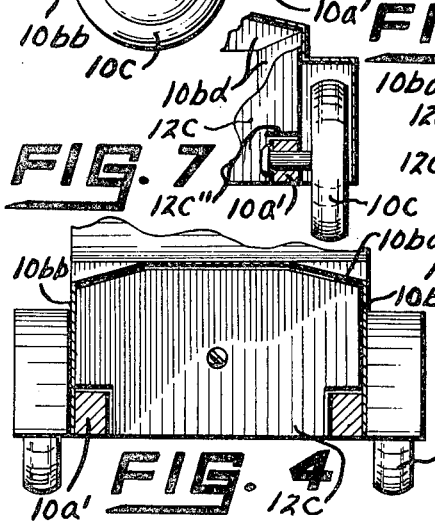
FIG. 7
FIG. 4
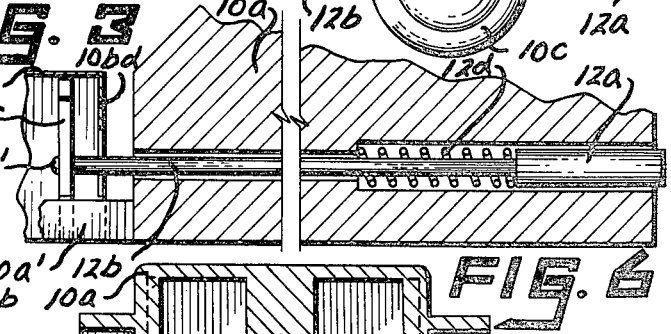
FIG. 6
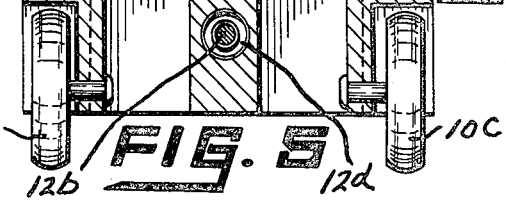
FIG. 5

TOY VEHICLE

This is a continuation of application Ser. No. 543,262, filed Jan. 23, 1975, now abandoned.

As is known, the popularity of play items, such as toys for the younger age group, continues to grow. In this connection, scaled-down vehicles, in various styles, have particular appeal, simulating, for example, racing cars or other units suitable for enacting adventuresome situations, thereby stimulating interest for the player. One difficulty with respect to such scaled-down or miniature vehicles is the possibility of damage thereto, and, as a consequence, the desirability of partial repair instead of complete replacement.

The invention affords a new concept for a play vehicle, basically defined, in the illustration herein, as an automobile, having any desired outer and/or inner configuration, but, importantly including, as a feature, a replaceable hood or front cover member.

Such hood is retained in operable position by a linearly movable spring-urged control or release rod which permits replacement of the hood, if and when desired. In other words, should the miniature automobile strike another miniature automobile, or any other object, the hood might become crimped or bent, necessitating, in the instance of the invention, the release of the spring-urged rod and the ready replacement of the damaged hood with another hood.

A better understanding of the present invention will become more apparent from the following description, taken in conjunction with the accompanying drawings, wherein FIG. 1 is a view in side elevation, partly broken away, showing a toy vehicle in accordance with the teachings of the present invention;

FIG. 2 is a top plan view of the toy vehicle of FIG. 1;

FIG. 3 is a view in vertical section, taken at line 3—3 of FIG. 2 and looking in the direction of the arrows, showing further details of the invention;

FIG. 4 is another view in vertical section, in this instance taken at line 4—4 of FIG. 1 and looking in the direction of the arrows, particularly showing the retaining plate for positioning the replaceable hood;

FIG. 5 is still a further view in vertical section, now taken at line 5—5 of FIG. 1 and looking in the direction of the arrows, showing other details of the rod spring-release mechanism;

FIG. 6 is a view in vertical section, partly fragmentary, showing the spring-urged member in a position achieving release of the hood; and, FIG. 7 is a view of further details of the instant toy vehicle, mostly in vertical section, but also fragmentary, generally taken at line 7-7 on FIG. 2 and looking in the direction of the arrows.

For the purposes of promoting and understanding of the principles of the invention, reference will now be made of the embodiment illustrated in the drawing and specific language will be used to describe the same. It will nevertheless be understood that no limitation of the scope of the invention is thereby intended, such alterations and further modifications of the illustrated device and such further applications of the principles of the invention as illustrated therein being contemplated as would normally occur to one skilled in the art to which the invention relates.

Referring now to the figures, a miniature vehicle 10 is disclosed, in this example simulating a conventional automobile. As usual, the automobile 10 includes a body portion **10*a*, which may be hollowed, as desired (see FIG. 5), a hood 10*b*, and front and rear wheels 10*c* supporting the vehicle. Typically, the body 10*a* and wheels 10*c* are made from a molded plastic resin, where the hood 10*b*, in a preferred form of the invention, is made from aluminum foil (exaggerated in thickness in FIG. 3**), or any deformable material.

At this point, it should be emphasized that while an automobile is shown in the drawing, the concept underlying the invention is appropriate to miniaturized trucks, racing type cars, tanks, airplanes or the like. As should be apparent from FIGS. 1, 3 and 4, the body **10*a* of the vehicle 10 includes runners 10*a'*, extending forwardly along both sides thereof, adapted to rotatably mount the aforesaid front wheels, while the rear wheels are rotatably mounted on the body portion 10*a* (see FIG. 5**).

The importance of the invention resides in the hood or front member **10*b*. In this connection, such hood or front member 10*b* is readily positioned, when in use, and typically, through a linearly moveable control or release rod 12, the latter extending longitudinally through a cavity or opening 10*a''* in the body portion 10*a* of the vehicle 10**.

The release rod 12 forms part of an assembly including a handle or pushing portion **12*a*, a smaller thickness elongated body portion 12*b*, a plate or clamp element 12*c* and a resilient member 12*d*. The plate 12*c* is threadedly secured, as by screw 12*c'*, to the elongated body portion 12*b*, while the resilient member 12*d*, a compression spring, encircles a part of the elongated body portion 12*b*, being contained, as should be apparent, within the cavity 10*a'* in the body 10*a* of the vehicle 10 and bearing against an inner surface of the cavity 10*a''* and an inner surface of the pushing portion 12*a***.

With particular reference now to FIGS. 4 and 7, the hood or front cover **10*b* has a top wall 10*ba*, side walls 10*bb*, a front wall 10*bc*, and inward flanges 10*bd* serving as a rear retaining surface. In order to accomplish positioning, the plate or clamp element 12*c* assumes a comparable configuration to that of the rear retaining surface 10*bd* of the hood 10*b* (FIG. 4), where such plate 12*c* firmly mounts the hood 10*b* in an assembled position (see FIG. 3**).

In this connection, the plate **12*c* has cut-out portions 12*c''* complimentary in shape to the runners 10*a'*, so as to prevent any twisting or misalignment of such plate 12*c*. Thus, the clamp element or plate 12*c*** effectively permits a completely integrated finished unit.

In use, when it is desired to place or replace the hood **10*b*, the release rod 12 is moved forwardly, as shown in FIG. 6, and the hood 10*b* set into position or removed and replaced. In other words, the plate 12*c* is urged against the inward flanges 10*bd* of the hood 10*b*, the latter bearing against the front surface, typically a fire wall, of the body portion 10*a* of the vehicle 10**.

Such an arrangement provides particular importance in the instance where the hood **10*b* is damaged during usage, as when the toy vehicle 10 strikes another toy vehicle or another object. Therefore, the value of the invention is extended, in that complete replacement of the vehicle 10 is not a necessity, but rather, merely a replacement of the hood 10*b*** is required, where the latter may be purchased separately to reduce costs to the purchaser and extend the life of the toy.

From the preceding, it should be apparent that the invention provides an efficient approach for achieving an extended life of usage for a miniature toy. The embodiment described herein is, of course, susceptible to various changes within the spirit of the invention, as, for example, proportioning, wheel mounting, alternative outward designs or the like. Thus, the above should be considered illustrative, and not as limiting the scope of the following claims:

I claim:

1. A toy vehicle comprising a wheel-mounted body, a removable engine hood adapted to be mounted on said body, a spring-urged linearly movable release member mounted within said body for movement in a direction longitudinally of said body, and a positioning plate mounted at one end of said release member, said positioning plate disposed within said removable engine hood and engaging an inner wall thereof to normally clamp said removable engine hood between said positioning plate and said body, and wherein the other end of said release member extends from said body and serves as a manual control for the selective release of said engine hood.

2. The toy vehicle of claim 1 wherein a compression spring encircles said release member, said body having a longitudinal cavity therein, said release member extending through said cavity, and said compression spring bearing against a surface of said release member and a surface of said cavity.

3. The toy vehicle of claim 1 wherein said removable engine hood is made from a deformable material.

* * * * *